US008549816B2

(12) United States Patent
Roberts

(10) Patent No.: US 8,549,816 B2
(45) Date of Patent: Oct. 8, 2013

(54) PANEL INSTALLATION SUPPORT APPARATUS

(76) Inventor: James F. Roberts, Liberty, MO (US)

( * ) Notice: Subject to any disclaimer, the term of this patent is extended or adjusted under 35 U.S.C. 154(b) by 108 days.

(21) Appl. No.: 13/364,402

(22) Filed: Feb. 2, 2012

(65) Prior Publication Data

US 2013/0199124 A1 Aug. 8, 2013

(51) Int. Cl.
*E04D 15/00* (2006.01)
*E04F 21/00* (2006.01)
*E04G 21/14* (2006.01)

(52) U.S. Cl.
USPC ..... 52/749.1; 52/DIG. 1; 269/37; 269/904

(58) Field of Classification Search
USPC ..... 52/94, 127.1, 127.2, 127.5, 127.6, 52/127.8, 483.1, 489.1, 489.2, 518, 506.06, 52/506.07, 506.09, 664, 669, 712–715, 749.1, 52/749.11, DIG. 1; 269/37, 43, 95, 97, 904; 248/544, 300, 317, 342, 343, 201, 313, 316.1
See application file for complete search history.

(56) References Cited

U.S. PATENT DOCUMENTS

| | | | | | |
|---|---|---|---|---|---|
| 2,715,780 | A | * | 8/1955 | Hageman | 33/648 |
| 4,158,455 | A | | 6/1979 | Brown | |
| 4,449,338 | A | | 5/1984 | Reicherts | |
| 4,485,543 | A | | 12/1984 | Flores, Jr. et al. | |
| 4,709,460 | A | * | 12/1987 | Luhowyj | 29/271 |
| 4,709,527 | A | | 12/1987 | Cooley | |
| 4,867,403 | A | | 9/1989 | Anderson | |
| 4,889,459 | A | | 12/1989 | Anderson | |
| 5,002,446 | A | | 3/1991 | Anderson | |
| 5,163,799 | A | | 11/1992 | Lynn | |
| 5,224,309 | A | * | 7/1993 | Bodell | 52/127.1 |
| 5,249,405 | A | | 10/1993 | Miller | |
| 5,366,329 | A | * | 11/1994 | Burgess | 411/368 |
| 5,371,994 | A | * | 12/1994 | Waters | 52/749.1 |
| 5,407,183 | A | * | 4/1995 | Singeltary | 269/43 |
| 5,655,337 | A | | 8/1997 | Bryant et al. | |
| 5,884,447 | A | * | 3/1999 | Earp | 52/489.1 |
| 6,131,361 | A | * | 10/2000 | Murphy | 52/712 |
| 6,161,824 | A | * | 12/2000 | Gustavson | 269/43 |
| 6,364,303 | B1 | | 4/2002 | Gustavson | |
| 6,467,236 | B1 | * | 10/2002 | Schlegel | 52/749.1 |
| 6,662,522 | B2 | | 12/2003 | Nichols et al. | |
| 6,904,732 | B1 | * | 6/2005 | Richmond | 52/749.1 |
| 7,448,598 | B1 | | 11/2008 | Elmlinger et al. | |
| 7,584,586 | B2 | | 9/2009 | Decker | |
| 7,694,464 | B2 | * | 4/2010 | Garcia et al. | 52/94 |
| 2005/0166484 | A1 | * | 8/2005 | Richmond | 52/127.12 |
| 2006/0185278 | A1 | | 8/2006 | Jaffe | |
| 2008/0040988 | A1 | | 2/2008 | Holt | |
| 2008/0110107 | A1 | * | 5/2008 | Decker | 52/127.2 |

* cited by examiner

*Primary Examiner* — Joshua J Michener
*Assistant Examiner* — Theodore Adamos
(74) *Attorney, Agent, or Firm* — Erikson Kernell Derusseau & Kleypas, LLC

(57) ABSTRACT

A panel installation support apparatus versatile and convenient for temporary attachment of the panel to a frame member includes an adjustable support surface for accommodating various panel thicknesses, a sloped surface to support the leading edge of the panel when positioning in place, and an alignment support shelf to properly align an edge of the panel with the joist or stud while supporting the edge of the panel. An accessory block may be used when standing a panel against a wall or when hanging drywall on sloped ceilings.

20 Claims, 9 Drawing Sheets

PANEL INSTALLATION SUPPORT APPARATUS

FIELD

The present invention relates to installation of building panels and, more particularly, to a support apparatus to temporarily support a drywall or other panel until an installer can secure the panel in place.

BACKGROUND

Installation of panels such as drywall is known in the art. Installation of drywall is particularly cumbersome, labor intensive and tiring, particularly for installation overhead on a ceiling. Drywall sheets are heavy and somewhat fragile if not handled and installed carefully. A drywall sheet is typically lifted by two persons, and supported in place by one person against the overhead joists or against wall studs while the second person secures the drywall in place with nails or screws. Drywall sheets are typically 48 or 54 inches wide and eight to 14 feet long. The standard thickness of drywall is one-half inch and five-eighths inch, but other thicknesses may be used such as one-quarter inch or three-eighths inch.

To properly install a sheet of drywall, the sheet should be held snug against the ceiling joists or wall studs and screwed or nailed in place starting from the center of the sheet and fanning out. If the sheet is not against or close to the studs or joists the screws or nails may pull through the drywall. If the corners or edges of the sheet are nailed or screwed first the edges or corners may break, or the middle of the sheet may bow resulting in an uneven or sagging installation or nail pop as the bow is pulled to the stud or joist and the nail or screw head pulls through the drywall. Additionally, supporting heavy sheets of drywall overhead throughout the day is tiring while trying to hold a sheet against the ceiling joists it is difficult to adjust, align reposition the heavy sheet.

There is a need for a support apparatus that is easy to use, quickly repositionable, can be used for both wood and metal studs, holds the sheet in close proximity to the stud or joist and is adaptable for various thicknesses of drywall.

SUMMARY

The present invention provides a panel installation support apparatus that is versatile and convenient for attachment of the panel to a frame member. The support apparatus includes an adjustable support surface for accommodating various panel thicknesses, a sloped surface to support the leading edge of the panel when positioning in place, and an alignment support shelf to properly align an edge of the panel with the joist or stud while supporting the edge of the panel. An accessory block may be used when standing a panel against a wall or when hanging drywall on sloped ceilings.

DETAILED DESCRIPTION OF THE DRAWINGS

DETAILED DESCRIPTION

As required, detailed embodiments of the present invention are disclosed herein. However, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within the numerical limits stated is generally preferred. Also, unless expressly stated to the contrary, the description of a group or class of materials as suitable or preferred for a given purpose in connection with the invention implies that mixtures or combinations of any two or more members of the group or class may be equally suitable or preferred.

Figure 1:
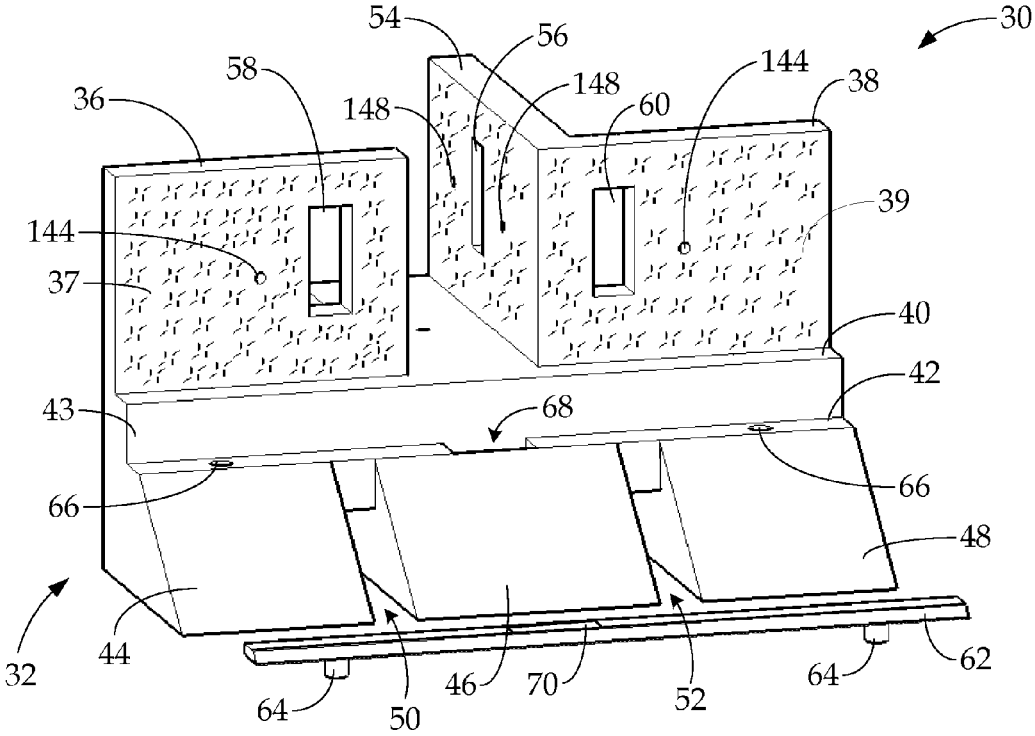
FIG. 1 is a front elevation perspective view of the panel support apparatus of the present invention.
Figure 2:
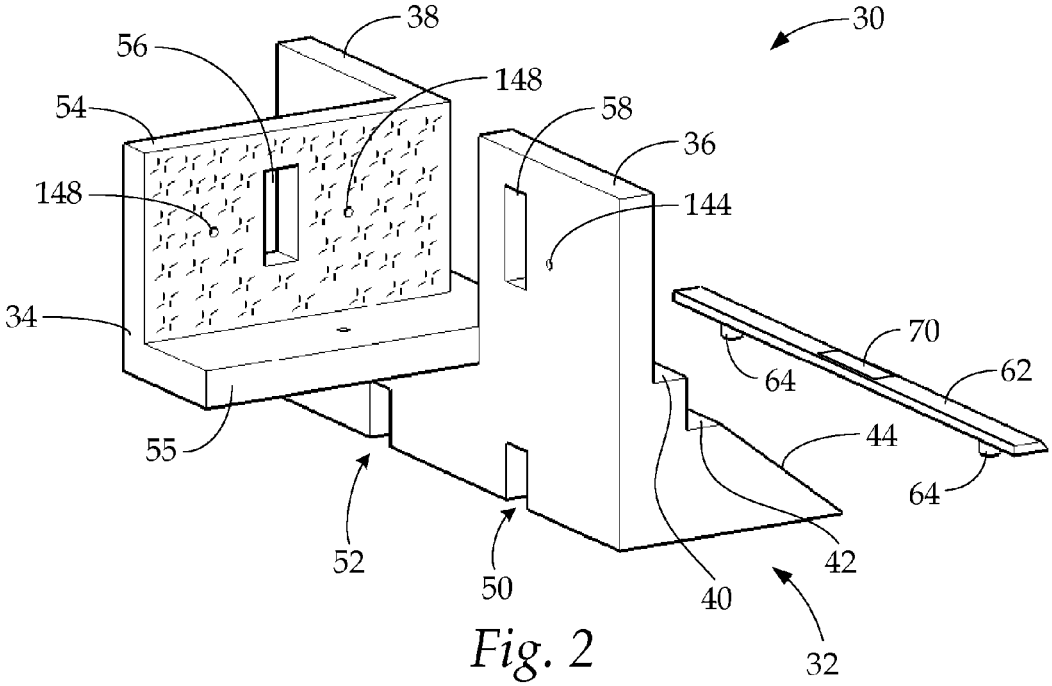
FIG. 2 is a right side elevation perspective view of FIG. 1.
Figure 3:
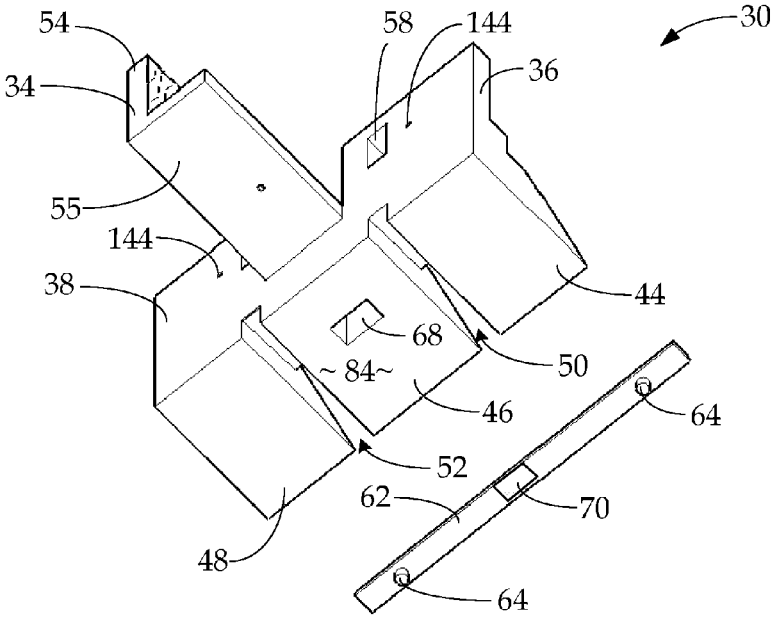
FIG. 3 is a bottom perspective view of FIG. 1.
Figure 4:
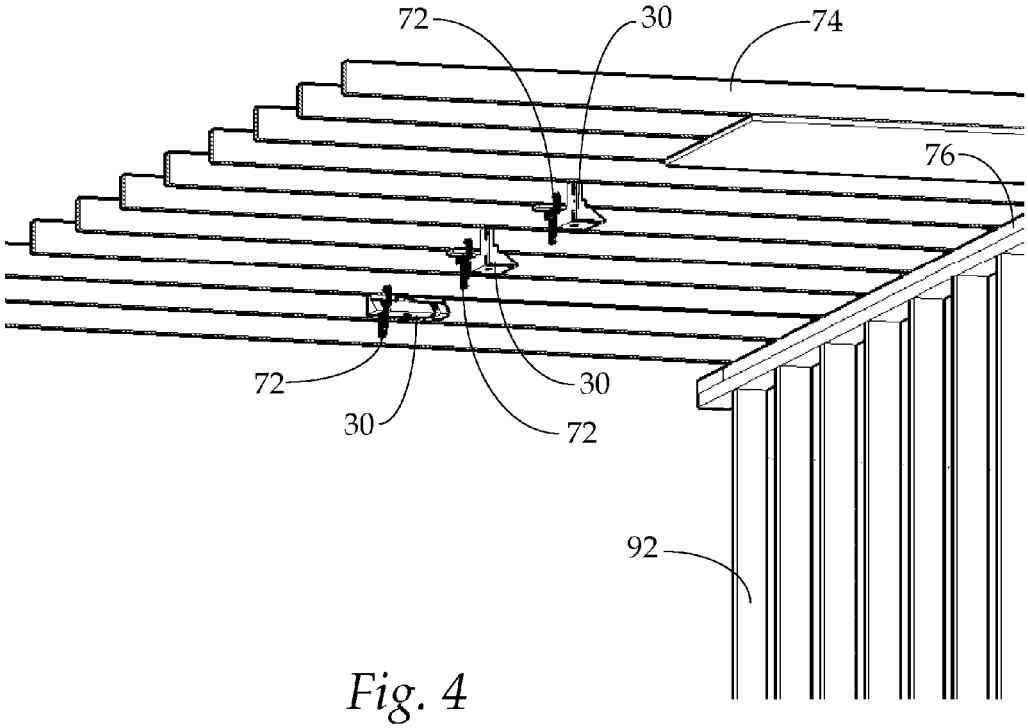
FIG. 4 is an overhead installation view showing three panel support apparatuses clamped to ceiling joists.

Referring initially to FIGS. 1-3, a panel support apparatus of the present invention is generally indicated by reference numeral 30. Panel support apparatus 30 has a generally L-shaped body 32 with a lateral supporting arm 34 extending rearwardly from and generally perpendicularly to the L-shaped body 32. The U-shaped body 32 includes right 36 and left 38 back members, an alignment ledge 40 for engaging a ceiling joist or wall stud, a panel support ledge 42 and sloped support members 44, 46 and 48 separated by clamping channels 50 and 52. The lateral supporting arm 34 includes a lateral back member 54 with a clamping window 56 and a lower leg 55. Right 36 and left 38 longitudinal back members include clamping windows 58 and 60 vertically aligned with channels 50 and 52, respectively. The back members 36, 38 and 54 include raised surface indicia to press into wood framing to keep the panel support apparatus from slipping and twisting.

The alignment ledge 40 has a width of approximately one-half inch. The height of the right 36 and left 38 back members may be two to three inches, for example. The panel support ledge 42 may be one-half inch wide and have a height of 11/16 to support a five-eighths inch drywall sheet. Generally, the height of panel support ledge 42 may be one-sixteenth inch more than the thickness of the drywall sheet to be hung. In the preferred embodiment, a thickness adjustment spacer 62 may be used to accommodate different drywall thicknesses. The spacer 62 includes two or more posts 64 spaced to engage apertures 66 in ledge 42. For example, if the panel support ledge 42 is eleven-sixteenths inch high, a five-eighths inch thick drywall panel may be supported with a one-sixteenth inch clearance between the drywall sheet and the joists or studs without a spacer 62. A one-half inch drywall panel may be hung by inserting a one-eighth inch thickness adjustment spacer 62 to maintain the one-sixteenth inch clearance.

An alignment window 68 is included through the panel support ledge 42 and sloped support member 46. Adjustment spacer 62 may also include an alignment window 70 aligned with the alignment window 68.

Referring to FIGS. 4-9, panel support apparatuses 30 are illustrated secured via C-clamp vice grips 72 to ceiling joists 74. To properly align the panel support apparatuses 30, a pencil or other mark is made across the ceiling joists 74 a distance from the wall header 76 equaling the length (or width) of the drywall sheet 78 to be hung. For example, if the drywall sheet is four feet wide, a mark 80 is made using a framing square perpendicularly across the joists 74 four feet from the wall header 76. Looking through the alignment window 70, the installer can align the mark 80 with alignment indicia 82 on the bottom surface 84 of the panel support apparatus 30.

Once the panel support apparatuses 30 are aligned and secured to the ceiling joists 74, the front edge 86 of the drywall sheet 78 is brought into contact with the sloped support members 44, 46 and 48. The panel 78 may now be pushed up the sloped surfaces until the front edge 86 comes to rest on the panel support ledges 42. The drywall sheet 78 may now be adjusted as desired while fully supported along the front edge 86. The widths of the alignment ledge 40 and the panel support ledge 42 provide adjustment space 88 for the drywall sheet 78. Once the installer is satisfied with the alignment of the drywall sheet 78, the sheet 78 may be screwed or nailed to the ceiling joists 74. When the drywall sheet 78 is secured to the ceiling joists 74, the C-clamp vice grips 72 may be released and the panel support apparatuses 30 may be moved to the next position to install another drywall sheet.

Figure 5:
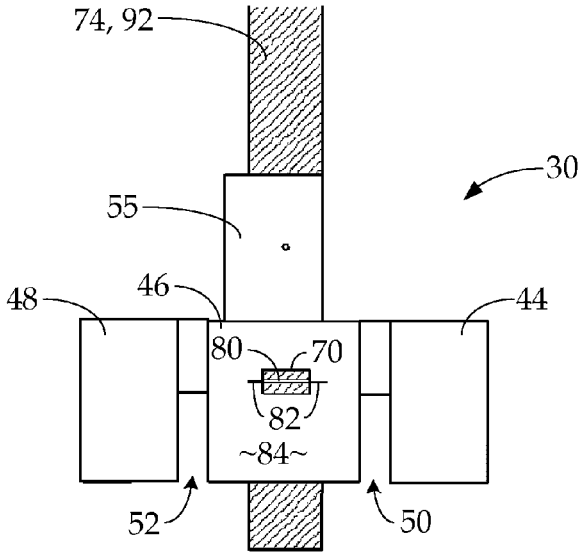
FIG. 5 is a bottom view looking up at one of the panel support apparatuses of FIG. 4.
Figure 6:
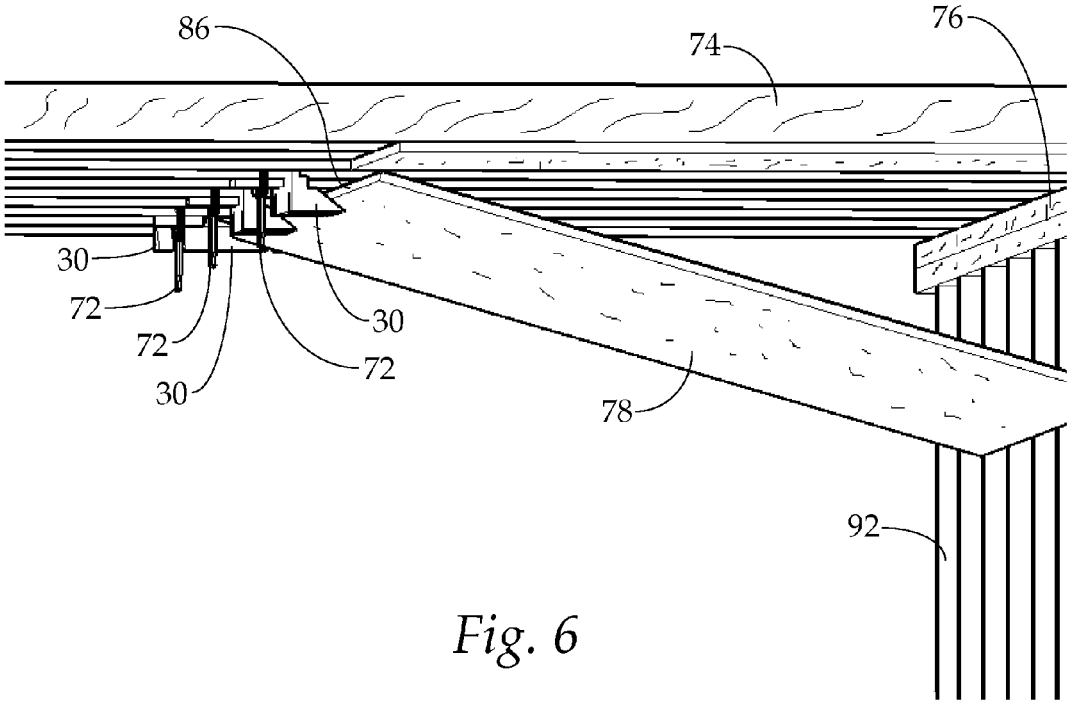
FIG. 6 is an overhead installation view showing a drywall sheet being supported by the panel support apparatuses.
Figure 7:
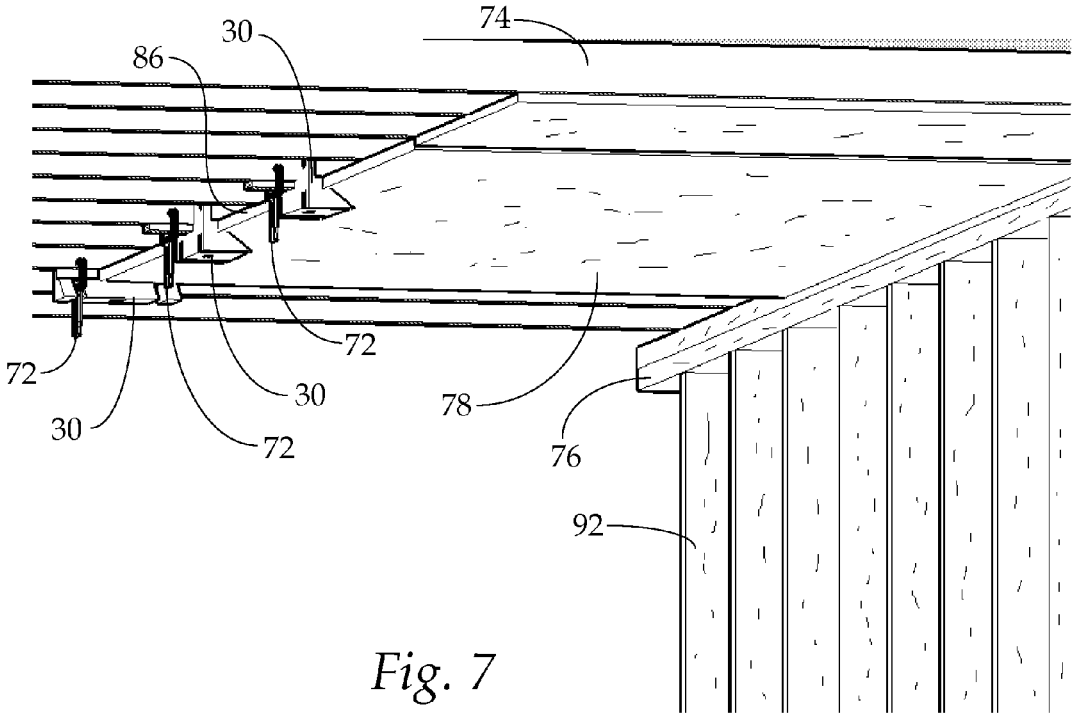
FIG. 7 is an overhead installation view showing a drywall sheet being supported by the panel support apparatus.
Figure 8:
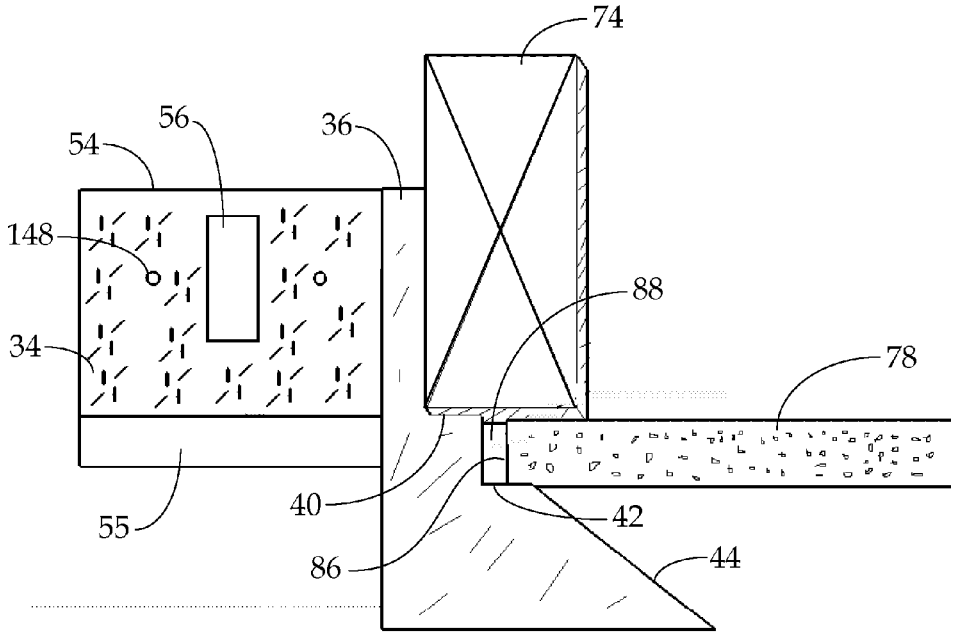
FIG. 8 is an end view of the panel support apparatus.
Figure 9:
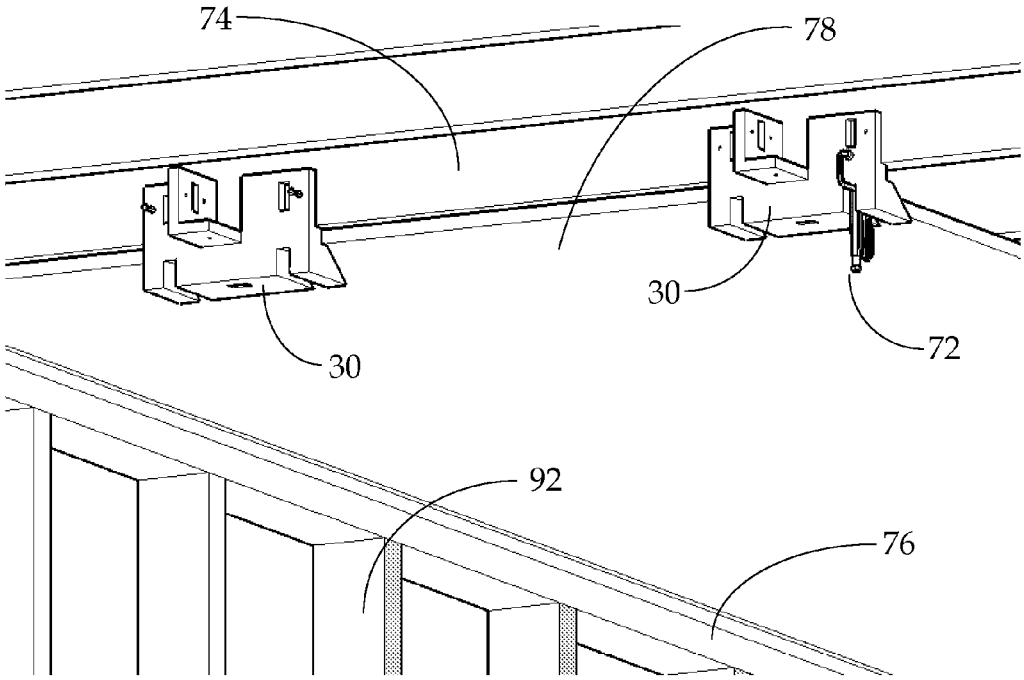
FIG. 9 is an overhead installation view showing a drywall sheet being supported along a longitudinal edge by the panel support apparatus.
Figure 10:
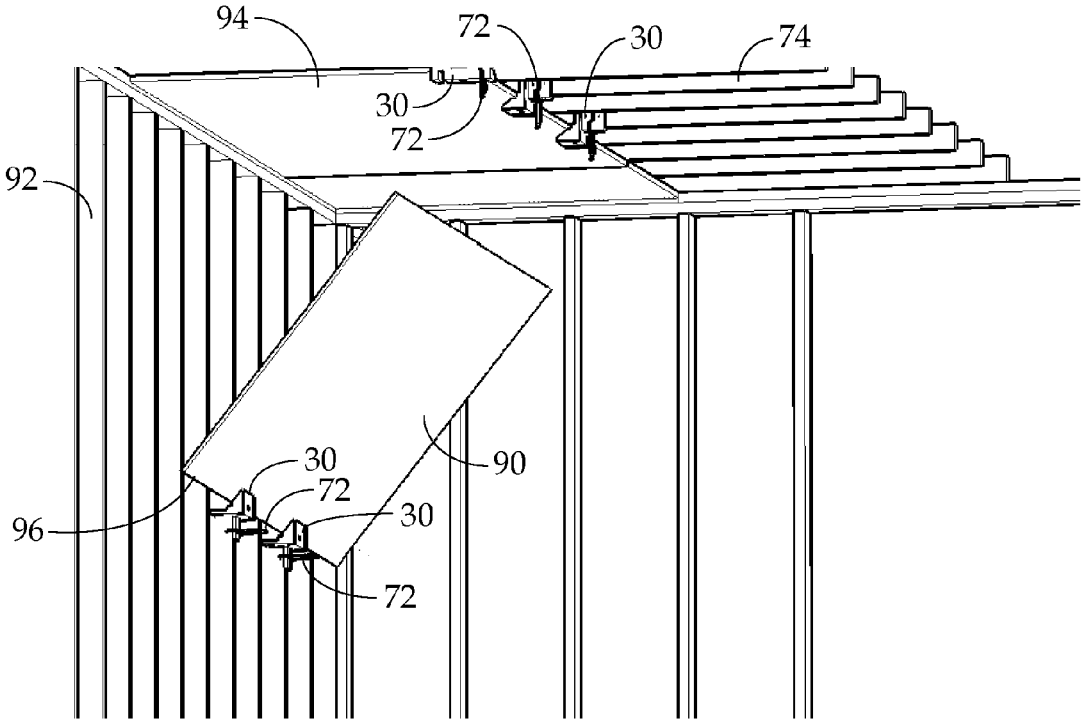
FIG. 10 is a wall installation view showing two panel support apparatuses clamped to wall studs supporting a drywall panel.
Figure 11:
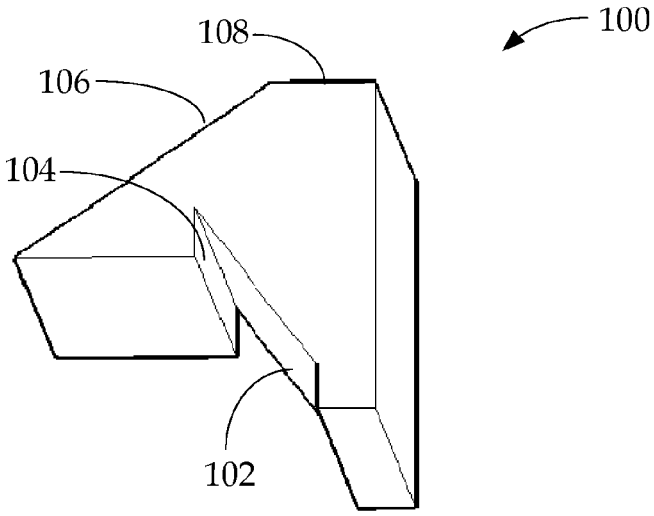
FIG. 11 is a perspective view of an accessory block for use with the panel support apparatus.
Figure 12:
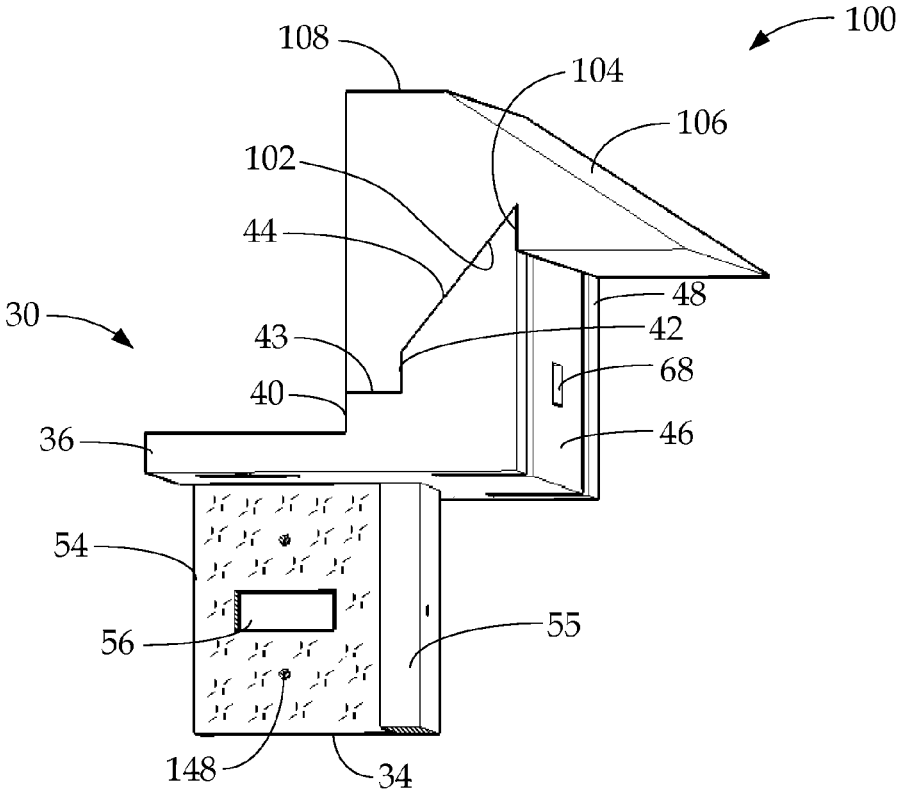
FIG. 12 is a perspective view of the accessory block of FIG. 11 engaged with the panel support apparatus.
Figure 13:
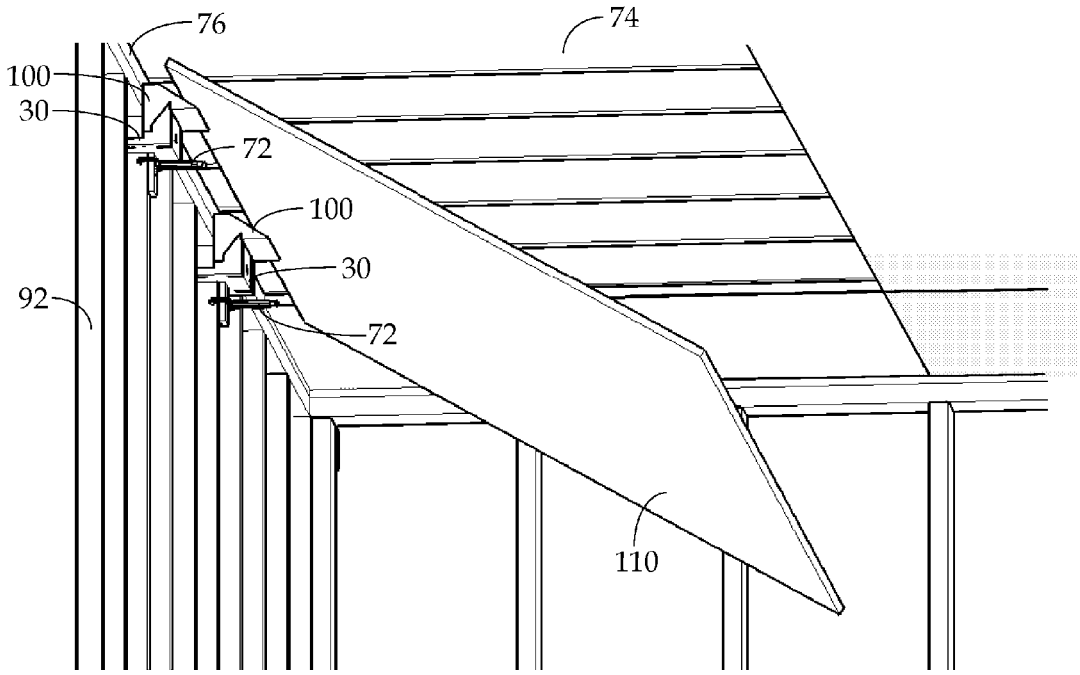
FIG. 13 is an overhead installation view showing two panel support apparatuses clamped to wall studs with engaged accessory blocks supporting a drywall sheet.
Figure 14:
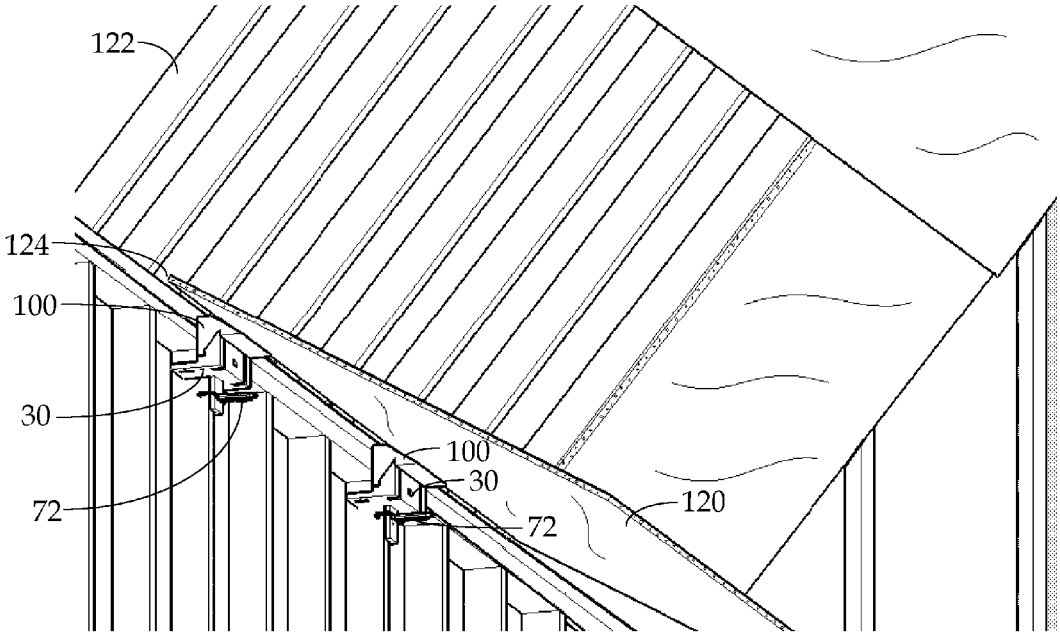
FIG. 14 is an overhead installation view showing two panel support apparatuses clamped to wall studs with engaged accessory blocks supporting a drywall panel for installation on a sloped ceiling.

Referring to FIGS. 5 and 10, when installing a drywall sheet 90 to wall studs 92, the panel support apparatuses 30 may be secured to the wall studs 92 via C-clamp vice grips 72. To properly align the panel support apparatuses 30 a pencil or other mark 80 is made across the wall studs 92 an equal distance from the ceiling 94 or other reference point equal to the length or width of the drywall sheet 90 depending on the orientation of the sheet 90 to be hung. Looking through the alignment window 70, the installer can align the mark 80 with the alignment indicia 82 on the bottom surface 84 of the panel support apparatus 30.

Once the panel support apparatuses 30 are aligned and secured with the C-clamp vice grips 72 to the wall studs 92, the bottom edge 96 of the drywall sheet 90 is brought into contact with the sloped support members 44, 46 and 48. The drywall sheet 90 is now supported along the bottom edge 96 and may be pivoted flat against the wall studs 92. The drywall sheet 90 may then be aligned as desired and secured to the wall studs 92.

Referring to FIGS. 11-14, an accessory block for use in combination with the panel support apparatus 30 is generally indicated by reference numeral 100. Accessory block 100 includes a beveled profile 102, which matches the profile of the sloped support members 44, 46 and 48, the panel support ledge 42 and alignment ledge 40. A lip 104 fits over the leading tip of the sloped support members 44, 46 and 48 to the lower surface 84 of the panel support apparatus 30. The accessory block includes a sloped support surface 106 extending from a top surface 108 in a plane which intersects a lower surface 84 plane. The top surface 108 lies in a plane parallel to the front surfaces 37 and 39 of right 36 and left 38 back members and surface 43 of panel support ledge 42.

When installing the last sheet of drywall 110 where the panel support apparatus 30 cannot be secured to the ceiling joists, the accessory blocks 100 may be used in combination with the panel support apparatuses 30. The panel support apparatuses 30 may be secured to the wall studs 92 with C-clamp vice grips 72. With the accessory block 100 in place, the drywall sheet 110 may be lifted and the front edge 112 placed on the sloped support surface 106. The drywall sheet 110 can then be raised and slid against the wall header 76, aligned as desired and secured to the ceiling joists 74 with screws or nails. When the drywall sheet 110 is being held against the ceiling joists 74, the front edge 112 rests on and is supported by the top surface 108 of the accessory block 100.

Similarly, when installing drywall sheets 120 on a vaulted ceiling 122, the panel support apparatuses 30 with the accessory blocks 100 may be secured to the wall studs 92 with C-clamp vice grips 72. With the accessory block 100 in place, the drywall sheet 120 may be lifted and the front edge 124 placed on the sloped support surface 106. The drywall sheet 120 can then be raised and held against the vaulted ceiling 122, aligned as desired and secured in place. When the drywall sheet 120 is being held against the vaulted ceiling 122, the front edge 124 rests on and is supported by the top surface 108 of the accessory block 100.

Figure 15:
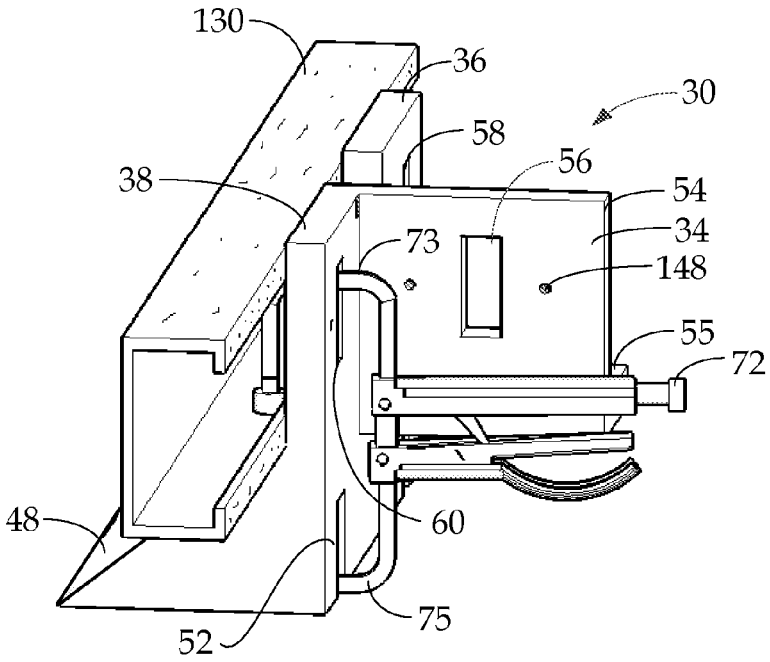
FIG. 15 is a side perspective view of the panel support apparatus clamped to a longitudinal metal stud.

Referring to FIG. 15, the panel support apparatus 30 is illustrated secured by a C-clamp vice grips 72 longitudinally to a steel stud or joist 130. The upper jaws 73 of the vice grips 72 passes through the clamping window 60 in the left back member 38 to clamp the lower flange 132 of the steel stud 130. The lower jaw 75 of the vice grips 72 is placed in the aligned clamping channel 52 to engage the panel support apparatus 30.

Figure 16:
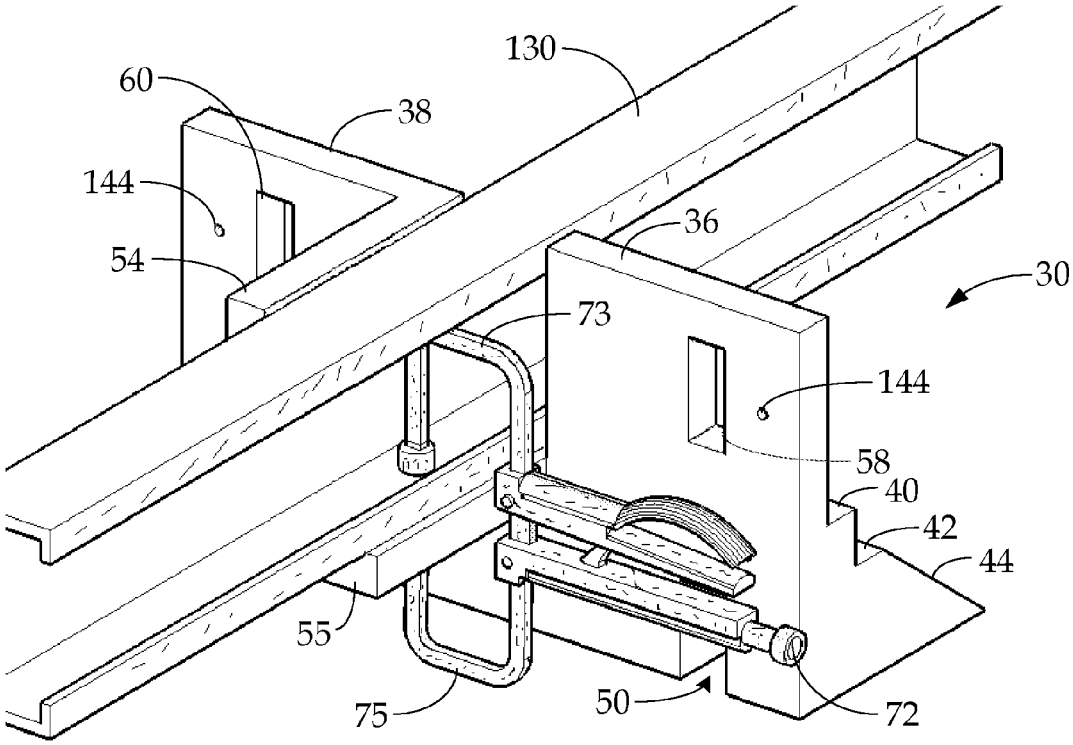
FIG. 16 is a back perspective view of the panel support apparatus clamped to a lateral metal stud.
Figure 17:
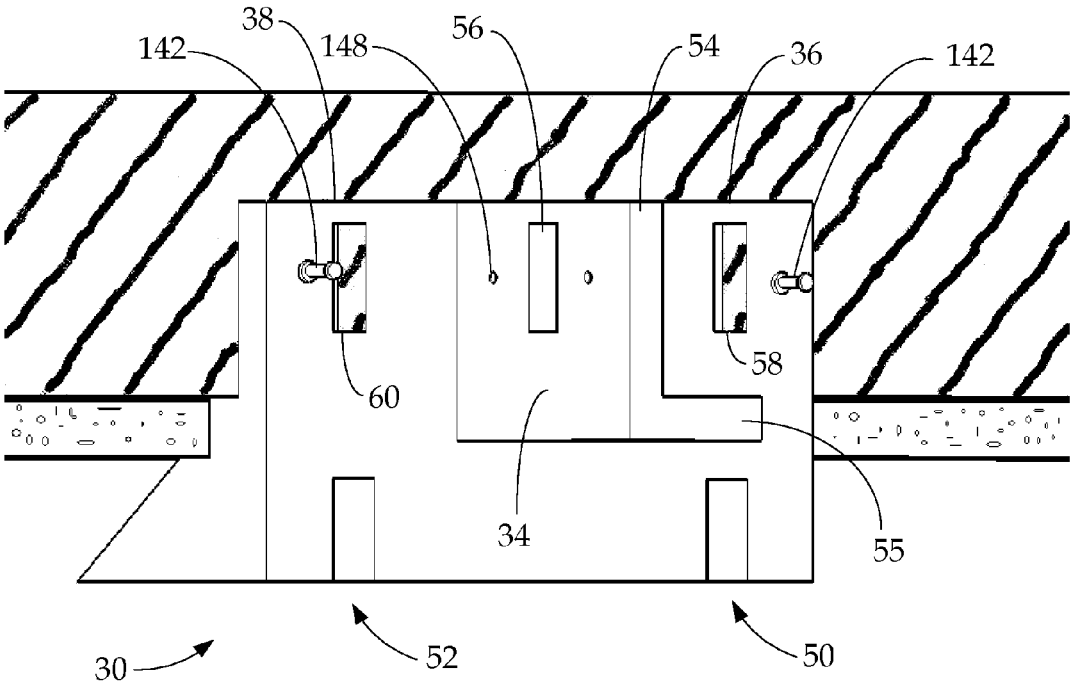
FIG. 17 is a back perspective view of the panel support apparatus secured to a joist with double-headed nails.

Referring to FIG. 16, the panel support apparatus 30 is illustrated secured by a C-clamp vice grips 72 laterally to a steel stud or joist 130. The upper jaw 73 of the vice grips 72 clamps the lower flange 132 of the steel stud 130 to the lower lea 55 of the supporting arm 34 opposite the lower jaw 75. For an orientation with the open channel of the steel stud 130 facing the lateral back member 54 of the lateral supporting arm 34, the upper jaw 73 passes through the clamping window 56 to clamp the lower flange 132 of the steel stud to the lower leg 55 opposite the lower jaw 75.

Referring to FIGS. 1-3 and 17, the panel support apparatus 30 may be temporarily secured longitudinally to a stud or joist 140 using double-headed nails 142 or screws passing through apertures 144 to support a drywall sheet 146. Similarly, for a lateral application (not shown), double-headed nails 142 or screws may be driven into a joist or stud through apertures 148 to temporarily secure the panel support apparatus 30 to the joist or stud to support a drywall sheet 146.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. In combination with a removable clamp having opposed clamping arms, a panel installation support apparatus comprising:

an L-shaped body having a vertical portion and a horizontal portion, said vertical portion of said L-shaped body having a front surface and a back surface, said horizontal portion having a bottom surface, an alignment ledge extending from said front surface of said vertical portion, a panel support ledge extending from said alignment ledge, and two or more support members extending from said panel support ledge to a free edge of said horizontal portion, a supporting arm extending laterally and rearwardly from said vertical portion of said L-shaped body, said supporting arm including a vertical portion and a horizontal portion, said vertical portion of said supporting arm having a front surface and a back surface and one or more clamping channels separating said two or more support members and adapted to receive an arm of said removable clamp, wherein said panel installation support apparatus is configured to be temporarily secured to a ceiling joist or wall stud through engagement with said alignment ledge by said removable clamp with one arm of said opposed clamping arms compressed against one side of the ceiling joist or wall stud, and the other arm of said opposed clamping arms compressed against said back of said vertical portion of said L-shaped body on an opposite side of the ceiling joist or wall stud.

2. The combination of claim 1 wherein said panel installation support apparatus is configured to be temporarily secured to said ceiling joist or wall stud through engagement with said supporting arm by said removable clamp with one arm of said opposed clamping arms compressed against one side of the ceiling joist or wall stud, and said other arm of said opposed clamping arms compressed against said back surface of said vertical portion of said supporting arm.

3. The combination of claim 2 further comprising an alignment window laterally aligned with said support arm and extending from said alignment ledge through said bottom surface of said L-shaped body, and alignment indicia on said bottom surface of said L-shaped body extending longitudinally across said alignment window to view a surface of the ceiling joist or wall stud engaged with said supporting arm.

4. The combination of claim 1 wherein said alignment ledge is approximately one-half inch wide.

5. The combination of claim 1 wherein said panel support ledge is approximately one-half inch wide.

6. The combination of claim 1 wherein said vertical portion of said L-shaped body includes an aperture extending from said front surface through said back surface of said vertical portion of said L-shaped body and vertically aligned with one of said one or more clamping channels, wherein said panel installation support apparatus is configured to be temporarily secured to a steel ceiling joist or steel wall stud having an open channel and lower flange through engagement with said alignment ledge by said removable clamp with one arm of said opposed clamping arms compressed against said bottom surface of said L-shaped body, and said other arm of said opposed clamping arms extending through said aperture in said vertical portion of said L-shaped body and into said open channel of said steel ceiling joist or steel wall stud and compressed against said lower flange of said steel ceiling joist or steel wall stud.

7. The combination of claim 1 wherein said vertical portion of said supporting arm includes an aperture extending from said front surface through said back surface of said vertical portion of said supporting arm, wherein said panel installation support apparatus is configured to be temporarily secured to a steel ceiling joist or steel wall stud having an open channel and lower flange through engagement with said supporting arm by said removable clamp with one arm of said opposed clamping arms compressed against said bottom surface of said supporting arm, and said other arm of said opposed clamping arms extending through said aperture in said vertical portion of said supporting arm and into said open channel of said steel ceiling joist or steel wall stud and compressed against said lower flange of said steel ceiling joist or steel wall stud.

8. The combination of claim 1 wherein said alignment ledge has a height of approximately eleven-sixteenths inch.

9. The combination of claim 1 further comprising a thickness adjustment spacer adapted to removably engage said panel support ledge to adjust the height of said alignment ledge.

10. The combination of claim 1 further comprising an accessory block having a sloped support surface extending from a top surface and adapted to releasably engage said horizontal portion of said L-shaped body.

11. In combination with a removable clamp having opposed clamping arms, a panel installation support apparatus comprising:

an L-shaped body having first and second vertical portions and a horizontal portion, said first and second vertical portions of said L-shaped body each having a front surface and a back surface, said horizontal portion having a bottom surface, an alignment ledge extending from said front surface of said first and second vertical portions, a panel support ledge extending from said alignment ledge, and three support members each extending from said panel support ledge to a free edge of said horizontal portion, a supporting arm extending laterally and rearwardly from said L-shaped body between said first and second vertical portions, said supporting arm including a vertical portion and a horizontal portion, said vertical portion of said supporting arm having a front surface and a back surface, and first and second clamping channels separating said three support members and adapted to receive an arm of said removable clamp, wherein said panel installation support apparatus is configured to be temporarily secured to a ceiling joist or wall stud through engagement with said alignment ledge by said removable clamp with one arm of said opposed clamping arms compressed against one side of the ceiling joist or wall stud, and the other arm of said opposed clamping arms compressed against said back of said first or second vertical portions of said L-shaped body on an opposite side of the ceiling joist or wall stud.

12. The combination of claim 11 wherein said panel installation support apparatus is configured to be temporarily secured to said ceiling joist or wall stud through engagement with said supporting arm by said removable clamp with one arm of said opposed clamping arms compressed against one side of the ceiling joist or wall stud, and said other arm of said opposed clamping arms compressed against said back surface of said vertical portion of said supporting arm.

13. The combination of claim 12 further comprising an alignment window laterally aligned with said support arm and extending from said alignment ledge through said bottom surface of said L-shaped body, and alignment indicia on said bottom surface of said L-shaped body extending longitudinally across said alignment window to view a surface of the ceiling joist or wall stud engaged with said supporting arm.

14. The combination of claim 1 wherein said alignment ledge is approximately one-half inch wide.

15. The combination of claim 11 wherein said panel support ledge is approximately one-half inch wide.

16. The combination of claim 11 wherein said first vertical portion of said L-shaped body includes an aperture extending from said front surface through said back surface of said first vertical portion of said L-shaped body and vertically aligned with said first clamping channel, wherein said panel installation support apparatus is configured to be temporarily secured to a steel ceiling joist or steel wall stud having an open channel and lower flange through engagement with said alignment ledge by said removable clamp with one arm of said opposed clamping arms compressed against said bottom surface of said L-shaped body, and said other arm of said opposed clamping arms extending through said aperture in said first vertical portion of said L-shaped body and into said open channel of said steel ceiling joist or steel wall stud and compressed against said lower flange of said steel ceiling joist or steel wall stud.

17. The combination of claim 11 wherein said second vertical portion of said L-shaped body includes an aperture extending from said front surface through said back surface of said second vertical portion of said L-shaped body and vertically aligned with said second clamping channel, wherein said panel installation support apparatus is configured to be temporarily secured to a steel ceiling joist or steel wall stud having an open channel and lower flange through engagement with said alignment ledge by said removable clamp with one arm of said opposed clamping arms compressed against said bottom surface of said L-shaped body, and said other arm of said opposed clamping arms extending through said aperture in said second vertical portion of said L-shaped body and into said open channel of said steel ceiling joist or steel wall stud and compressed against said lower flange of said steel ceiling joist or steel wall stud.

18. The combination of claim 11 wherein said vertical portion of said supporting arm includes an aperture extending from said front surface through said back surface of said vertical portion of said supporting arm, wherein said panel installation support apparatus is configured to be temporarily secured to a steel ceiling joist or steel wall stud having an open channel and lower flange through engagement with said supporting arm by said removable clamp with one arm of said opposed clamping arms compressed against said bottom surface of said supporting arm, and said other arm of said opposed clamping arms extending through said aperture in said vertical portion of said supporting arm and into said open channel of said steel ceiling joist or steel wall stud and compressed against said lower flange of said steel ceiling joist or steel wall stud.

19. The combination of claim 11 further comprising a thickness adjustment spacer adapted to removably engage said panel support ledge to adjust the height of said alignment ledge.

20. The combination of claim 11 further comprising an accessory block having a sloped support surface extending from a top surface and adapted to releasably engage said horizontal portion of said L-shaped body.

* * * * *